US007119665B2

(12) United States Patent
Albert

(10) Patent No.: US 7,119,665 B2
(45) Date of Patent: Oct. 10, 2006

(54) SOUND GENERATOR FOR A KITE

(76) Inventor: Abdallah Joe Albert, 4914 San Bernardo, Laredo, TX (US) 78041

( * ) Notice: Subject to any disclaimer, the term of this patent is extended or adjusted under 35 U.S.C. 154(b) by 147 days.

(21) Appl. No.: 10/983,743

(22) Filed: Nov. 9, 2004

(65) Prior Publication Data

US 2006/0097853 A1 May 11, 2006

(51) Int. Cl.
*G08B 3/00* (2006.01)

(52) U.S. Cl. ..... 340/404.2; 340/392.2; 340/404.1; 446/397; 244/153 R

(58) Field of Classification Search ..... 340/384.1, 340/392.1, 392.2, 396.1, 404.1, 404.2; 244/153 A, 244/153 R, 155 R; 446/213, 397, 404
See application file for complete search history.

(56) References Cited

U.S. PATENT DOCUMENTS

| | | | | |
|---|---|---|---|---|
| 2,893,663 | A | 7/1959 | Wilson | 244/154 |
| 3,194,521 | A | 7/1965 | Rider et al. | 244/154 |
| 3,727,864 | A | 4/1973 | Tolomizenko | 244/154 |
| 3,770,229 | A | 11/1973 | Seefluth | 244/154 |
| 4,180,221 | A * | 12/1979 | Harris | 244/13 |
| 4,336,915 | A * | 6/1982 | Stoecklin et al. | 244/153 R |
| 4,634,085 | A | 1/1987 | Cuesta et al. | 244/153 R |
| 4,752,051 | A * | 6/1988 | Chang | 244/155 R |
| 5,381,988 | A | 1/1995 | Kattas | 244/153 A |
| 5,598,988 | A * | 2/1997 | Bukur | 244/153 A |
| 5,954,297 | A * | 9/1999 | Bukur | 244/153 A |
| 6,283,413 | B1 * | 9/2001 | Bukur | 244/153 A |
| D460,789 | S | 7/2002 | Wang | D21/446 |
| 6,494,764 | B1 | 12/2002 | Tom | 446/397 |
| 6,678,979 | B1 | 1/2004 | Lim et al. | 40/412 |

* cited by examiner

*Primary Examiner*—Van T. Trieu
(74) *Attorney, Agent, or Firm*—Stephen R. Greiner

(57) ABSTRACT

A sound generator including a mounting clip for attachment to a kite frame. A support arm is secured to, and projects from, the mounting clip. The support arm has a distal end remote from the mounting clip. A pivot mechanism is secured to the distal end of the support arm. A siren housing is secured to the pivot mechanism for pivoting movement relative to the mounting clip. A wind-powered siren is positioned within the siren housing.

7 Claims, 2 Drawing Sheets

SOUND GENERATOR FOR A KITE

FIELD OF THE INVENTION

The present invention relates generally to aeronautical devices and, more particularly, to kites.

BACKGROUND OF THE INVENTION

Hobbyists have flown kites for centuries. To enhance the sensory aspects of the flying experience, many hobbyists produce highly ornamented kites that resemble, among other things, amphibians, people, boats, and full-scale aircraft. Unfortunately, these kites are virtually silent in the air, the only sounds coming from them being soft rustlings caused by the passage of wind over their lifting surfaces.

SUMMARY OF THE INVENTION

In light of the fact that most kites flown today emit no sounds when flown, it is a principal object of the invention to provide a sound generator for a kite. The sounds emitted by the generator preferably mimic those from a full-scale jet aircraft engine; however, the sounds can be varied. It is believed that such sounds will make kite flying more enjoyable for hobbyists.

It is another object of the invention to provide a sound generator of the type described that can be readily transferred from one kite to another, thus permitting the sound generator to be employed with virtually any kite in the squadron of a hobbyist. The transfer of the sound generator from kite to kite can be accomplished without special tools or extensive training. The sound generator is particularly intuitive to use.

It is another object of the present invention to provide a sound generator of the type described that is not powered by batteries or other electrical means. The sound generator is, in fact, powered by the wind so that whenever the sound generator is being flown, sound is produced.

It is an additional object of the present invention to provide a sound generator of the type described whose configuration can be adjusted to ensure that the maximum airflow through the sound generator is achieved regardless of the kite to which it is attached and the flying conditions present at the time of its use. Thus, a user can maximize the sound volume.

It is a further object of the invention to provide a sound generator of the type described that can be configured to look like a full-scale jet engine. While in use, the sound generator appears to be propelling the kite through the sky.

Still another object of the invention is to provide a sound generator as described that can be secured to a kite bearing a representation of a jet aircraft. A kite equipped with one or more sound generators can fool an earth-bound observer into thinking that he is observing a real aircraft at high altitude.

It is an object of the invention to provide improved elements and arrangements thereof in a sound generator for the purposes described that is lightweight in construction, inexpensive to manufacture, and dependable in use.

Briefly, the sound generator in accordance with this invention achieves the intended objects by featuring a mounting clip having a tubular body with a slot running its length to provide the tubular body with a pair of opposed jaws dimensioned to grip a kite frame. A support arm is secured to, and projects from, the mounting clip. A pivot mechanism is secured to the distal end of the support arm. The pivot mechanism includes a pair of toothed wheels joined by an axle. A first one of the toothed wheels is integrally formed with the support arm and has an abutment surface with a number of ridges radiating outwardly from its center. The second of the toothed wheels has a similar abutment surface for frictional engagement with the abutment surface of the first one of the toothed wheels. A siren housing is secured to the second toothed wheel for pivoting movement relative to the mounting clip. The siren housing has a tubular body with a slot running its length to provide the tubular body thereof with a pair of opposed jaws. A wind-powered siren is positioned between the jaws of the siren housing. The siren includes a tubular horn with a freewheeling turbine positioned therein.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
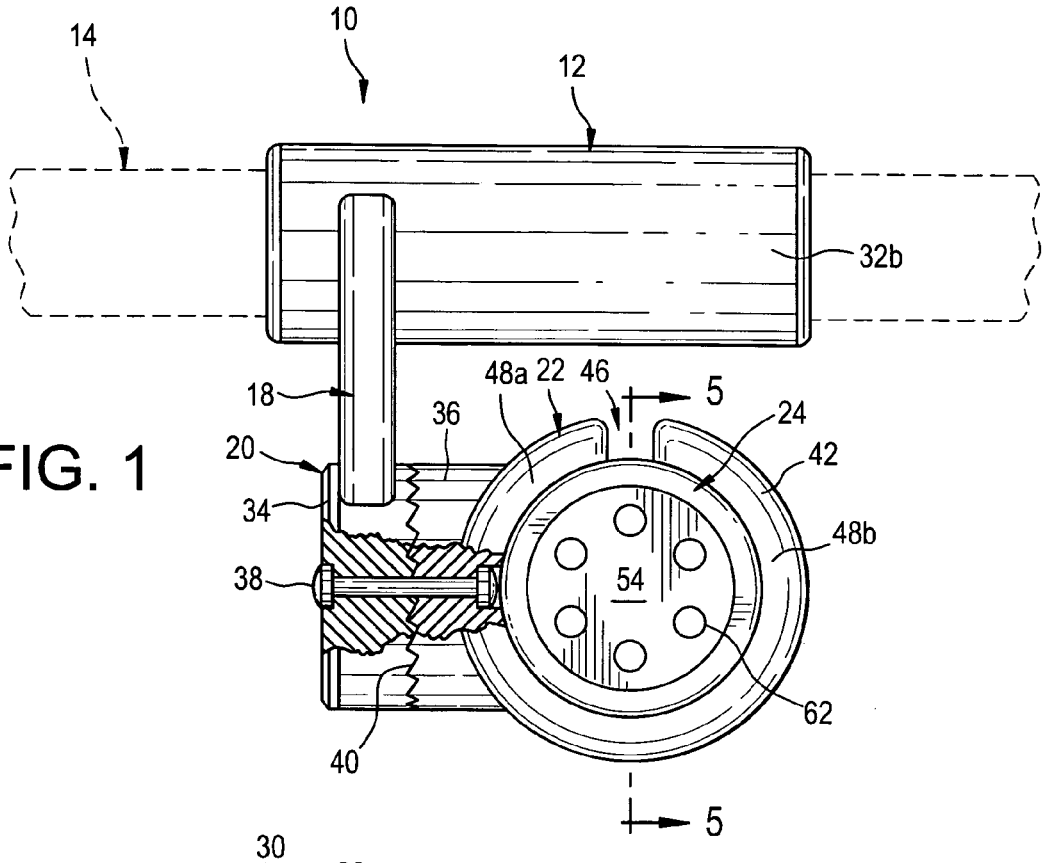
FIG. 1 is a front view of a sound generator for a kite with portions broken away to reveal details thereof.
Figure 2:
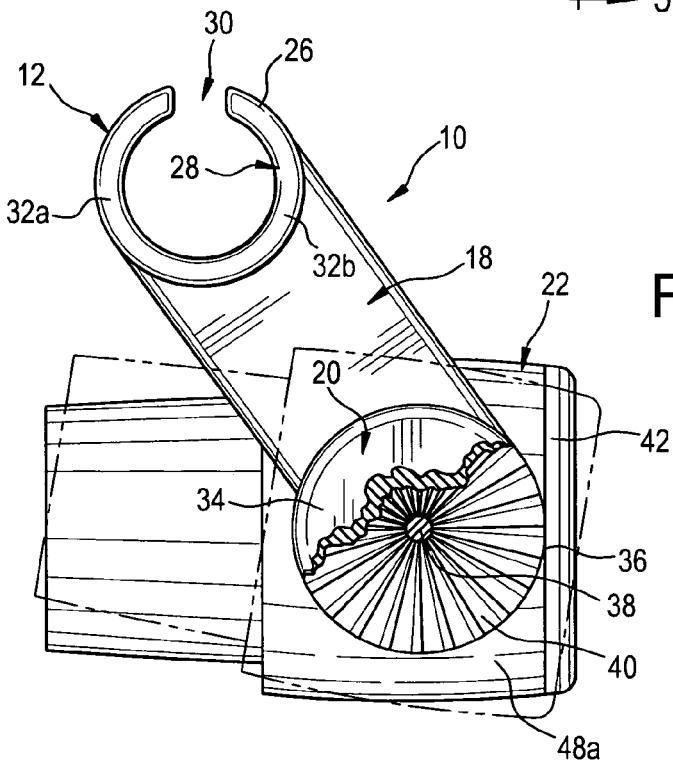
FIG. 2 is a side view of the sound generator of FIG. 1.
Figure 3:
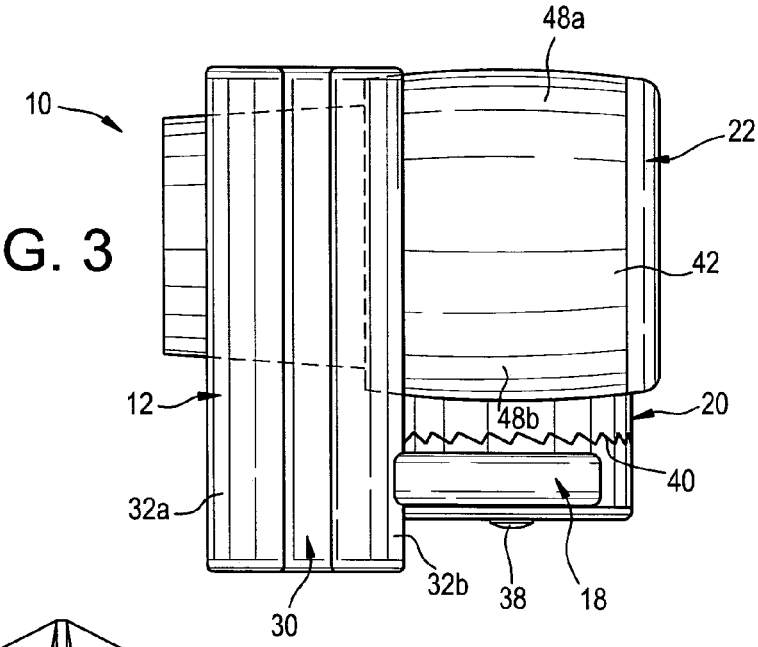
FIG. 3 is a top view of the sound generator.
Figure 4:
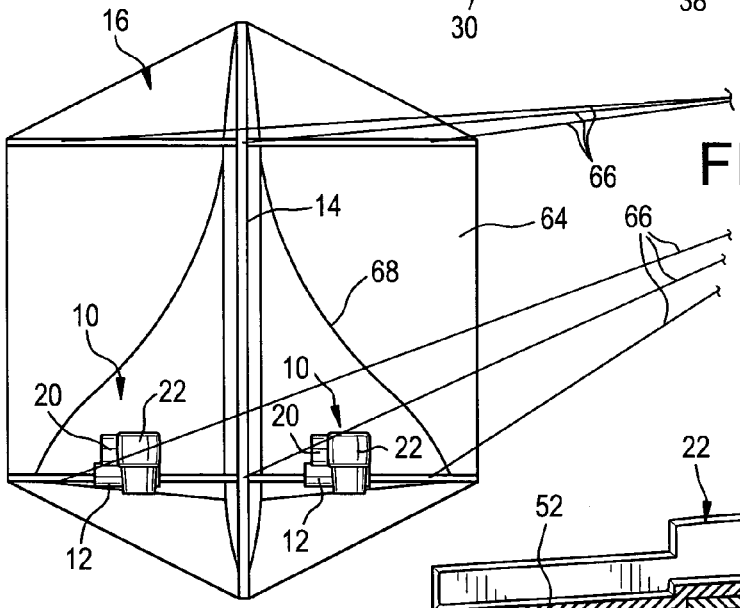
FIG. 4 is a bottom view of a kite from which a pair of sound generators is suspended.

Referring now to the FIGS., a sound generator in accordance with the present invention is shown at 10. Sound generator 10 includes a mounting clip 12 for attachment to the rigid frame 14 of a kite 16. Projecting from clip 12 is a support arm 18 at the distal end of which is provided a pivot mechanism 20. A siren housing 22 is carried by pivot mechanism 20. Positioned within housing 22 is a siren 24 that, when introduced to wind upon the launch of kite 16, emits an audible tone reminiscent of that produced by a jet engine.

Mounting clip 12 has a tubular body 26 dimensioned to receive a portion of frame 14 of kite 16 within its interior space 28. A slot 30 runs the length of tubular body 26 and provides body 26 with a pair of opposed jaws 32*a* and 32*b*. As body 26 is formed of a resilient material, jaws 32*a* and 32*b* can be temporarily spread apart for the passage of frame 14 into interior space 28. Once frame 14 is seated within interior space 28, jaws 32*a* and 32*b* spring back to their original positions to tightly grip frame 14.

Support arm 18 projects downwardly from tubular body 26. As shown, arm 18 is integrally fastened to jaw 32*b* to aid in holding clip 12 and spreading jaws 32*a* and 32*b* apart. To this end, arm 18 is provided with dimensions that will minimize the likelihood of failure when it is used as a handle or lever and during impacts with the ground in the event of a crash of kite 16. Further, arm 18 can be projected at any desired angle from tubular body 26 and can have one that resembles the boom typically employed to support an jet engine beneath the wing of a full-sized aircraft.

Pivot mechanism 20 includes a pair of toothed wheels 34 and 36 joined side-by-side by an axle 38. Wheel 34 is integrally formed with support arm 18 whereas wheel 36 is integrally formed with siren housing 22. Each wheel 34 and 36 is provided with an abutment surface defined by a number of spoke-like ridges 40 that radiate outwardly from axle 38 at its center. Ridges 40 of wheels 34 and 36 mesh with one another and inhibit the relative rotation of wheels 34 and 36. By carefully setting the length of axle 38, the resistance to pivoting afforded by mechanism 20 can be adjusted to suit the desires of a user. It should be noted, however, that little resistance is required since mechanism 20 only need to oppose the force of a wind upon housing 22.

Siren housing 22 is integrally formed with wheel 36. Housing 22 includes a tubular body 42 that can be configured to resemble a full-scale jet engine and is dimensioned to receive siren 24 within its interior space 44. The longitudinal axis of tubular body 42 is oriented at right angles relative to the longitudinal axis of tubular body 26. A slot 46 runs the length of tubular body 42 and provides body 42 with a pair of opposed jaws 48*a* and 48*b*. As body 42 is formed of a resilient material, jaws 48*a* and 48*b* can be temporarily spread apart to admit siren 24 into interior space 44. Once siren 24 is seated within interior space 44, jaws 48*a* and 48*b* spring back to their original positions to tightly grip siren 24.

Figure 5:
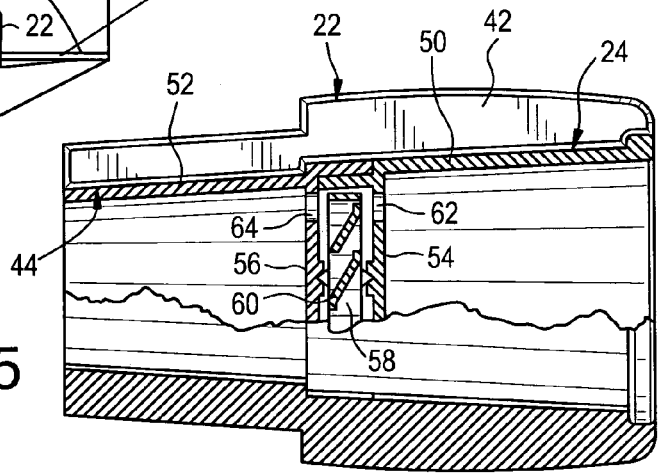
FIG. 5 is a cross-sectional view taken along line 5—5 of FIG. 1.

Siren 24 is a tubular horn having an inlet portion 50 and an outlet portion 52 secured together at their inner ends. An inlet plate 54 is provided at the inner end of inlet portion 50 and an outlet plate 56 is provided at the inner end of outlet portion 52. As shown in FIG. 5, inlet plate 54 and outlet plate 56 are spaced from one another and a freewheeling turbine 58 is journaled between them. Turbine 58 is caused to rotate and emit a whine reminiscent of that produced by a jet engine on a full-sized aircraft when air is passed over and between its radial fan blades 60. Air is admitted to turbine 58 via ports 62 and 64 provided about the peripheries of inlet plate 54 and outlet plate 56.

By changing the configurations of the various features of siren 24, particularly that of turbine 58, siren 24 can be made to emit sounds that range in tone from a low drone to a high whine. Nonetheless, siren 24 as described herein encompasses any and all devices capable of generating an audible tone when struck by wind including, but not limited to, devices with vibrating diaphragms or reeds, tuned pipes and whistles.

A pair of sound generators 10 is used with a kite 16 to simulate jet engines on the left and right wings of an aircraft. Kite 16 includes a substantially rigid frame 14 to which is secured a flexible sheet 64 that serves as a lifting surface for kite 16. A number of tethers 66 extend from frame 14 that can be tied together or to a single line and held by a hobbyist.

Flexible sheet 64 is provided with indicia 68 showing the silhouette or other representation of a jet aircraft. The supersonic Concorde is the particular type of aircraft represented by indicia 68. Indicia 68 can be provided to sheet 64 by conventional printing or weaving processes or, in the alternative, can take the form of a hologram capable of realistically showing an aircraft in three dimensions or other forms such as, but not limited to, birds through a hologram or through a model or picture.

Use of sound generator 10 with kite 16 is straightforward. First, after kite 16 is assembled at a flying site, a pair of sound generators 10 are secured by means of mounting clips 12 to opposite sides of frame 14 at the rear of kite 16 to simulate jet engines. Next, wheels 34 and 36 of pivot mechanism 20 are rotated relative to one another so as to point housing 22 and siren 24 directly into the wind when kite 16 is flown. (Some experimentation may be required as the precise angle will be a function of wind speed, air temperature, kite type and loading.) Once siren 24 faces directly into the wind, turbine 58 begins to rotate and emit a jet-like sound at maximum volume. As much of the tethers 66 as desired can be extended by the hobbyist to place kite 16 at a desired altitude. In flight, kite 16 closely resembles a modern jet aircraft in terms of sound and appearance.

When flying of kite 16 is completed for the day, tethers 66 are reeled in and kite 16 is disassembled for easy transport and storage. Sound generators 10 ate detached from frame 14 and can be stored with kite 16 in a carrying case, vehicle trunk or, perhaps, in a jacket pocket. If a user wishes to fly another kite 16, sound generators 10 can be immediately deployed therewith by following the steps outlined above. Sound generators 10 are always ready for use.

While the invention has been described with a high degree of particularity, it will be appreciated by those skilled in the art that modifications may be made thereto. For example, sound generators can be deployed with kites of any sort such as the Rokkaku-type shown above or even box, cellular, delta or figure kites. Further, housing 22 could be configured to support a plurality of sirens 24 side-by-side to provide a greater sound volume and to mimic aircraft with multiple jet engines suspended from a single boom. Therefore, it is to be understood that the present invention is not limited to the sole embodiment described above but encompasses any and all embodiments within the scope of the following claims.

I claim:

1. A sound generator, comprising:

a mounting clip for attachment to a kite frame;

a support arm secured to, and projecting from, said mounting clip, said support arm having a distal end remote from said mounting clip;

a pivot mechanism secured to said distal end of said support arm;

a siren housing secured to said pivot mechanism for pivoting movement relative to said mounting clip; and, a wind-powered siren positioned within said siren housing.

2. The sound generator according to claim 1 wherein said mounting clip includes a tubular body formed of a resilient material and having a slot running the length thereof so as to provide said tubular body with a pair of opposed jaws dimensioned to tightly grip said kite frame.

3. The sound generator according to claim 1 wherein said pivot mechanism includes a pair of toothed wheels joined by an axle, a first one of said toothed wheels being integrally formed with said support arm and a second one of said toothed wheels being integrally formed with said siren housing, the first one of said toothed wheels having a first abutment surface with a plurality of first ridges radiating outwardly from the center thereof, and the second one of said toothed wheels having a second abutment surface, for frictional engagement with said first abutment surface, with a plurality of second ridges radiating outwardly from the center thereof.

4. The sound generator according to claim 1 wherein said siren housing including a tubular body formed of a resilient material and having a slot running the length thereof so as to provide said tubular body with a pair of opposed jaws dimensioned to tightly grip said siren.

5. The sound generator according to claim 1 wherein wind-powered siren comprises a tubular horn with a freewheeling turbine positioned therein.

6. A sound generator, comprising:

a mounting clip for attachment to a kite frame, said mounting clip including a first tubular body having a first slot running the length thereof so as to provide said first tubular body with a first pair of opposed jaws dimensioned to tightly grip said kite frame;

a support arm secured to, and projecting from, said mounting clip, said support arm having a distal end remote from said mounting clip;

a pivot mechanism secured to said distal end of said support arm, said pivot mechanism including a pair of toothed wheels joined by an axle, a first one of said toothed wheels being integrally formed with said support arm and having a first abutment surface with a plurality of first ridges radiating outwardly from the center thereof, and a second one of said toothed wheels having a second abutment surface, for frictional engagement with said first abutment surface, with a plurality of second ridges radiating outwardly from the center thereof;

a siren housing secured to the second one of said toothed wheels of said pivot mechanism for pivoting movement relative to said mounting clip, said siren housing including a second tubular body having a second slot running the length thereof so as to provide said second tubular body with a second pair of opposed jaws; and, a wind-powered siren positioned between said second pair of opposed jaws, said siren including a tubular body with a freewheeling turbine positioned therein.

7. A sound-generating kite, comprising:

a substantially rigid kite frame;

a flexible sheet secured to said kite frame for lifting said kite from the ground in the presence of wind;

at least one tether attached to said frame for preventing said kite from blowing away in the presence of wind;

a sound generator secured to said kite, said sound generator including:

a mounting clip attached to said kite frame;

a support arm secured to, and projecting from, said mounting clip, said support arm having a distal end remote from said mounting clip;

a pivot mechanism secured to said distal end of said support arm;

a siren housing secured to said pivot mechanism for pivoting movement relative to said mounting clip; and, a wind-powered siren positioned within said siren housing.

* * * * *